US010506877B1

(12) United States Patent
Edwards, II

(10) Patent No.: US 10,506,877 B1
(45) Date of Patent: Dec. 17, 2019

(54) COLLAPSIBLE TIE RACK

(71) Applicant: John W. Edwards, II, La Follette, TN (US)

(72) Inventor: John W. Edwards, II, La Follette, TN (US)

( * ) Notice: Subject to any disclaimer, the term of this patent is extended or adjusted under 35 U.S.C. 154(b) by 0 days.

(21) Appl. No.: 15/852,044

(22) Filed: Dec. 22, 2017

(51) Int. Cl.

| | |
|---|---|
| ***A47B 61/04*** | (2006.01) |
| ***A47B 61/02*** | (2006.01) |
| ***A47B 46/00*** | (2006.01) |
| *A47G 25/06* | (2006.01) |
| *A47B 96/06* | (2006.01) |

(52) U.S. Cl.
CPC ..... *A47B 61/04* (2013.01); *A47B 46/00* (2013.01); *A47B 61/02* (2013.01); *A47B 96/067* (2013.01); *A47G 25/06* (2013.01); *A47G 25/0685* (2013.01)

(58) Field of Classification Search
CPC ..... A47G 25/74; A47G 25/743; A47G 5/743; A47G 25/0685; A47G 25/06; A47B 61/04; A47B 61/02; A47B 46/00; A47B 96/067
USPC ... 211/13.1, 85.2, 85.3, 85.5, 30, 32, 35, 38, 211/87.01, 95, 96, 99, 100, 104, 113, 211/115, 116, 118, 150, 165, 167–171, 211/195; 223/85, 88, 89, 90, 94, DIG. 1; 108/134, 135, 152; 206/806
See application file for complete search history.

(56) References Cited

U.S. PATENT DOCUMENTS

| | | | | | |
|---|---|---|---|---|---|
| 426,313 | A * | 4/1890 | Paxson | A47G 25/0685 | 211/99 |
| 506,554 | A * | 10/1893 | Schermerhorn | A47G 25/0685 | 211/96 |
| 524,869 | A * | 8/1894 | Sheets | A47G 25/0685 | 211/99 |
| 527,003 | A * | 10/1894 | Nicholas | A47G 25/746 | 211/85.3 |
| 611,929 | A * | 10/1898 | Norris | A47G 25/0685 | 211/99 |
| 620,638 | A * | 3/1899 | Boucher | A47G 25/0685 | 211/99 |
| 664,063 | A * | 12/1900 | Stare | A47G 25/0685 | 211/99 |
| 813,239 | A * | 2/1906 | Rosenberg | A47G 25/0685 | 211/99 |
| 971,493 | A * | 9/1910 | Crane | A47G 25/0685 | 211/99 |

(Continued)

*Primary Examiner* — Jonathan Liu
*Assistant Examiner* — Devin K Barnett
(74) *Attorney, Agent, or Firm* — Sanchelima & Associates, P.A.; Christian Sanchelima; Jesus Sanchelima

(57) ABSTRACT

A collapsible tie rack includes a frame member and a hanging assembly. The frame member is configured to be mounted on a wall and encloses a space. The hanging assembly comprises brace members hingedly attached to an inner surface of the frame member to pivot about an end of the frame member to extend from a collapsed configuration to an open configuration and retract from the open configuration to the collapsed configuration. The hanging rods are fixedly attached to the brace members and spaced apart in a parallel arrangement to hang a plurality of ties. In the collapsed configuration, the hanging assembly is retracted and positioned within the space enclosed by the frame member. The hanging assembly is detachably attached to the frame member via one or more attachment elements, for example, latches, etc.

4 Claims, 3 Drawing Sheets

(56) References Cited

Figure 1A:
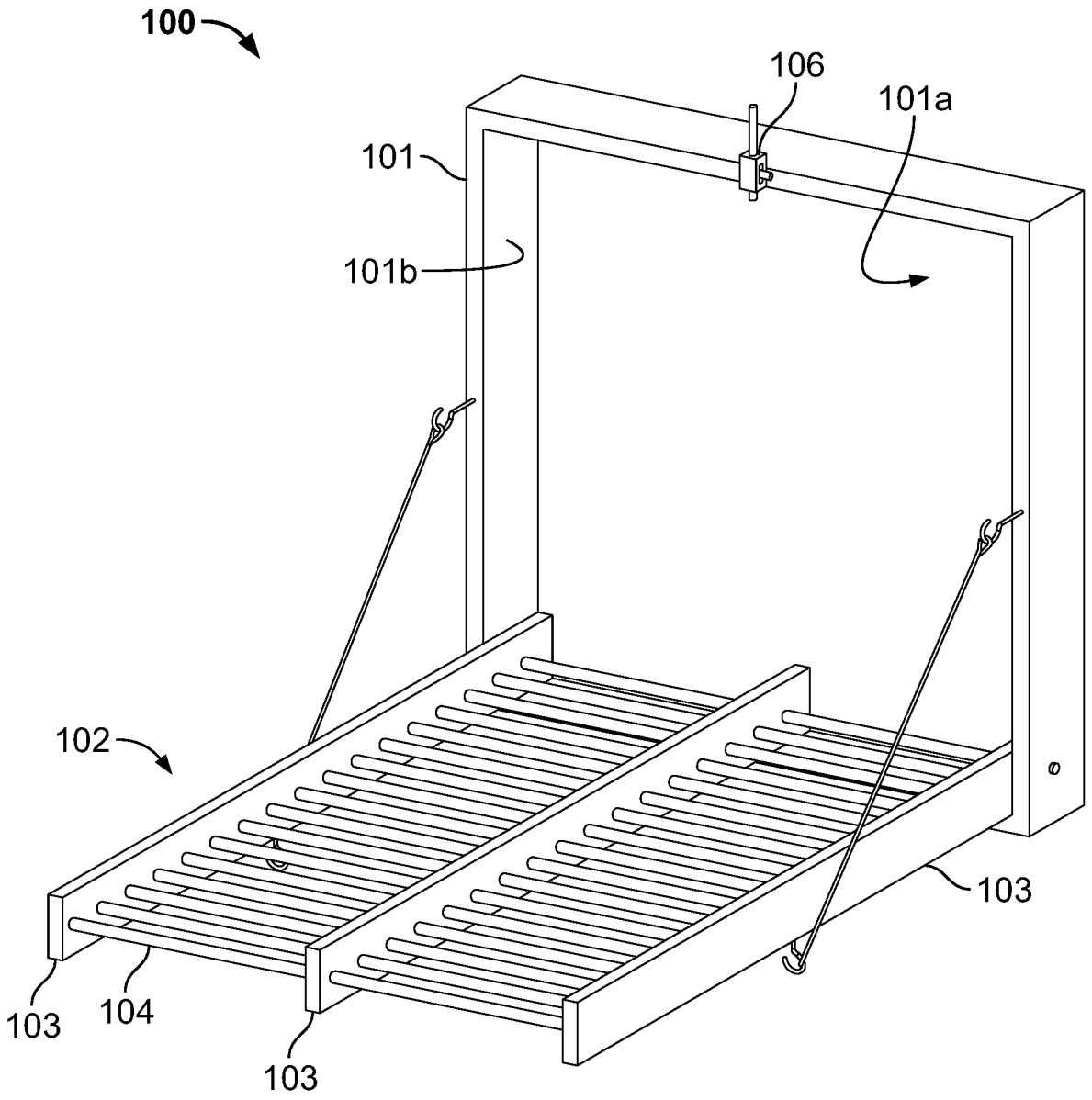

U.S. PATENT DOCUMENTS 978,423 A * 12/1910 Zizinia ..... A47G 25/0685 211/99
986,788 A * 3/1911 Wilson ..... A47G 25/746 211/104
1,551,468 A * 8/1925 Chapman ..... D06F 57/12 211/99
1,654,341 A * 12/1927 Mendiolagoitia .... A47G 25/746 211/45
1,767,545 A * 6/1930 Mossbacher ..... A47G 25/746 211/106
1,788,166 A * 1/1931 Marden ..... A47K 10/04 211/99
1,836,008 A * 12/1931 Anzalone ..... D06F 57/12 211/94.03
1,982,972 A * 12/1934 Roosendael ..... A47B 5/04 211/99
2,070,174 A * 2/1937 Pace ..... A47G 25/746 211/99
2,099,495 A * 11/1937 Mirel ..... A47G 25/746 211/97
2,147,172 A * 2/1939 Poole ..... D06F 57/12 211/99
2,275,968 A * 3/1942 Kissinger ..... A47G 25/746 211/110
2,305,629 A * 12/1942 Magnuson ..... A47B 43/00 108/134
2,398,858 A * 4/1946 Rosenblatt ..... A47B 77/14 211/96
2,433,247 A * 12/1947 Stowell ..... A47G 25/0685 211/100
2,434,242 A * 1/1948 Hermes ..... A47G 25/0685 211/99
2,440,549 A * 4/1948 Kiser ..... A47B 61/02 211/99
2,471,349 A * 5/1949 Reiss ..... A47G 25/746 211/104
2,474,436 A * 6/1949 Pestyner ..... A47G 25/746 211/104
2,562,622 A * 7/1951 Laughlin ..... A47G 25/746 211/100
2,569,761 A * 10/1951 Hibbs ..... A47G 25/74 211/1.3
2,615,579 A * 10/1952 Sampson ..... A47G 25/746 211/100
2,666,530 A * 1/1954 Beren ..... A47G 25/746 211/104
2,675,130 A * 4/1954 Dore ..... A47G 25/18 211/118
2,875,903 A * 3/1959 Shourds ..... A47B 61/02 211/100
2,948,406 A * 8/1960 Steele ..... A47G 25/0685 211/99
3,211,295 A * 10/1965 Weiss ..... A47G 25/0685 211/100
3,642,143 A * 2/1972 Cass ..... A47B 61/00 211/85.3
3,920,127 A 11/1975 LaBeaud
4,109,794 A * 8/1978 Samuel ..... A47G 25/746 211/100
4,126,231 A * 11/1978 Derwent-Wryde ..... B42F 15/00 211/99
4,171,748 A * 10/1979 Fabian ..... A47G 25/0685 211/1.3
4,611,721 A * 9/1986 Heckaman ..... A47G 25/746 211/100
D301,524 S * 6/1989 Trafford ..... D6/324
4,863,043 A * 9/1989 Bowen ..... A47G 25/74 211/113
5,019,126 A * 5/1991 Post ..... A47G 25/0685 211/100
5,022,722 A * 6/1991 Wallin ..... A47B 61/00 211/1.3
D330,468 S * 10/1992 Jester, Jr. ..... D6/552
D353,943 S * 1/1995 Varin ..... D6/317
5,542,758 A * 8/1996 Brown ..... A47B 61/00 211/1.3
5,584,404 A * 12/1996 Tsai ..... A47B 46/00 108/29
5,645,178 A * 7/1997 Conley, Jr. ..... A47F 5/08 211/87.01
6,085,868 A * 7/2000 Anthony ..... A01M 31/02 108/152
6,431,093 B1 * 8/2002 Hansen ..... B60R 3/005 108/135
6,726,036 B2 * 4/2004 Koellner ..... D06F 57/12 211/104
6,729,481 B1 * 5/2004 O'Brien ..... A47B 73/00 211/74
6,959,786 B2 * 11/2005 Craft ..... A01M 31/02 108/152
7,127,829 B2 * 10/2006 Wuster ..... D06F 57/04 34/239
8,453,852 B2 * 6/2013 Raddatz ..... D06F 57/12 211/104
8,584,601 B1 * 11/2013 Deschner ..... B25H 1/04 108/134
9,717,358 B2 * 8/2017 Davis ..... A47G 25/746
D806,407 S * 1/2018 Nelson ..... D6/324
2005/0103730 A1 * 5/2005 Hosilyk ..... A47F 7/17 211/85.5
2006/0266721 A1 * 11/2006 Gregory ..... A47F 7/12 211/85.3
2009/0250417 A1 * 10/2009 McNiff ..... A47G 25/746 211/85.3
2011/0155024 A1 * 6/2011 McCaffrey ..... B60N 3/004 108/26
2012/0138557 A1 * 6/2012 Lee ..... D06F 57/06 211/85.3
2014/0001135 A1 * 1/2014 Bukowski ..... D06F 57/12 211/100
2015/0129622 A1 * 5/2015 MacLaren ..... A47G 25/743 223/85
2016/0120351 A1 * 5/2016 Davis ..... A47G 25/746 211/85.3

* cited by examiner

COLLAPSIBLE TIE RACK

I. BACKGROUND OF THE INVENTION

1. Field of the Invention

The present disclosure generally relates to tie storage devices. More particularly, the present disclosure relates to a collapsible tie rack designed to store a plurality of ties within a small space.

2. Description of the Related Art

For most individuals, a significant amount of time is spent every day during a work week on deciding what to wear. Deciding quickly between Casual, formal, or business casual demands an organized closet or predetermined clothing choices. Organizers, for example, ranging from tie racks to watch organizers serve to efficiently utilize space and provide an optimal display to enable an individual to quickly decide and access what he/she wishes to wear. Tie racks that effectively retain and display ties are well known in the art. Typically, tie racks are mounted within a clothes closet. A large and expansive clothes closet is a luxury not everyone can afford and therefore it is highly desirable that tie racks be compact and use minimal space. A tie rack, which is compact and has minimal space requirements, is required Several tie racks have been proposed for display and storage purposes. For instance, a tie rack is disclosed in U.S. Pat. No. 4,611,721, which is mounted on a wall or a ceiling or on the outside of a closet door. The disclosed tie rack is difficult to access if mounted on the ceiling. Further, since the ties are exposed and not restrained, the possibility of ties stored in the tie rack accidentally encountering a passerby and falling off is high. A tie rack, which provides easy access and prevents stored ties from easily falling off, is therefore required. It is toward this need that the present invention is directed.

Other proposed prior art devices lacked compactness and efficient space utilization, or like many devices such as that described by LaBeaud in U.S. Pat. No. 3,920,127, early efforts lacked retention means and therefore allowed objects or coils stored thereon to fall off. Another prior patent by Eric J. McNiff et al. in U.S. Pat. No. 20090250417 describes a tie rack comprising a frame moveably mounted on a support bracket. The frame comprises an arm mounted on the support bracket via an arm fixing element. The entire weight of the assembly including that of the ties is supported by the support bracket and may result in the support bracket failing to support the frame member over time. An alternative, which can support several ties without failure and not unduly complicated in structure and hence prohibitively expensive to produce, is therefore required.

Hence, there is a long felt but unresolved need for a tie rack, which is compact and has minimal space requirements. Furthermore, there is a need for a tie rack, which provides easy access and prevents stored ties from easily falling off. Accordingly, a need still exists for the creation of a retractable tie hanger device for installation on flat surfaces which, when not in use, can be placed in a non-obtrusive retracted state. Moreover, there is a need for a tie rack, which can support several ties without failure and not unduly complicated in structure and hence prohibitively expensive to produce.

II. SUMMARY OF THE INVENTION

The invention, disclosed herein, addresses the above-mentioned need for a tie rack, which is compact and has minimal space requirements. Furthermore, the present invention addresses the need for a tie rack, which provides easy access and prevents stored ties from easily falling off. Moreover, the invention addresses the need for a tie rack, which can support several ties without failure and not unduly complicated in structure and hence prohibitively expensive to produce. It is an object of the present invention to provide a compact device, which attaches to a substantially flat surface, either vertically or horizontally, and which, when not in use is capable of being folded into a retracted state to occupy a much reduced and non-obtrusive space.

The present invention, disclosed herein, comprises a frame member and a hanging assembly. The frame member is configured to be mounted on a wall and encloses a space. The hanging assembly comprises a plurality of brace members hingedly attached to an inner surface of the frame member. The brace members are configured to pivot about an end of the frame member to extend from a collapsed configuration to an open configuration and retract from the open configuration to the collapsed configuration. The hanging rods are fixedly attached to the brace members and spaced apart in a parallel arrangement to hang a plurality of ties. In the collapsed configuration, the hanging assembly is retracted and positioned within the space enclosed by the frame member. The hanging assembly is detachably attached to the frame member via one or more attachment elements, for example, latches.

Further objects of the invention will be brought out in the following part of the specification, wherein detailed description is for the purpose of fully disclosing the invention without placing limitations thereon.

III. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1A exemplarily illustrates a front perspective view of a collapsible tie rack in an open configuration.

Figure 1B:
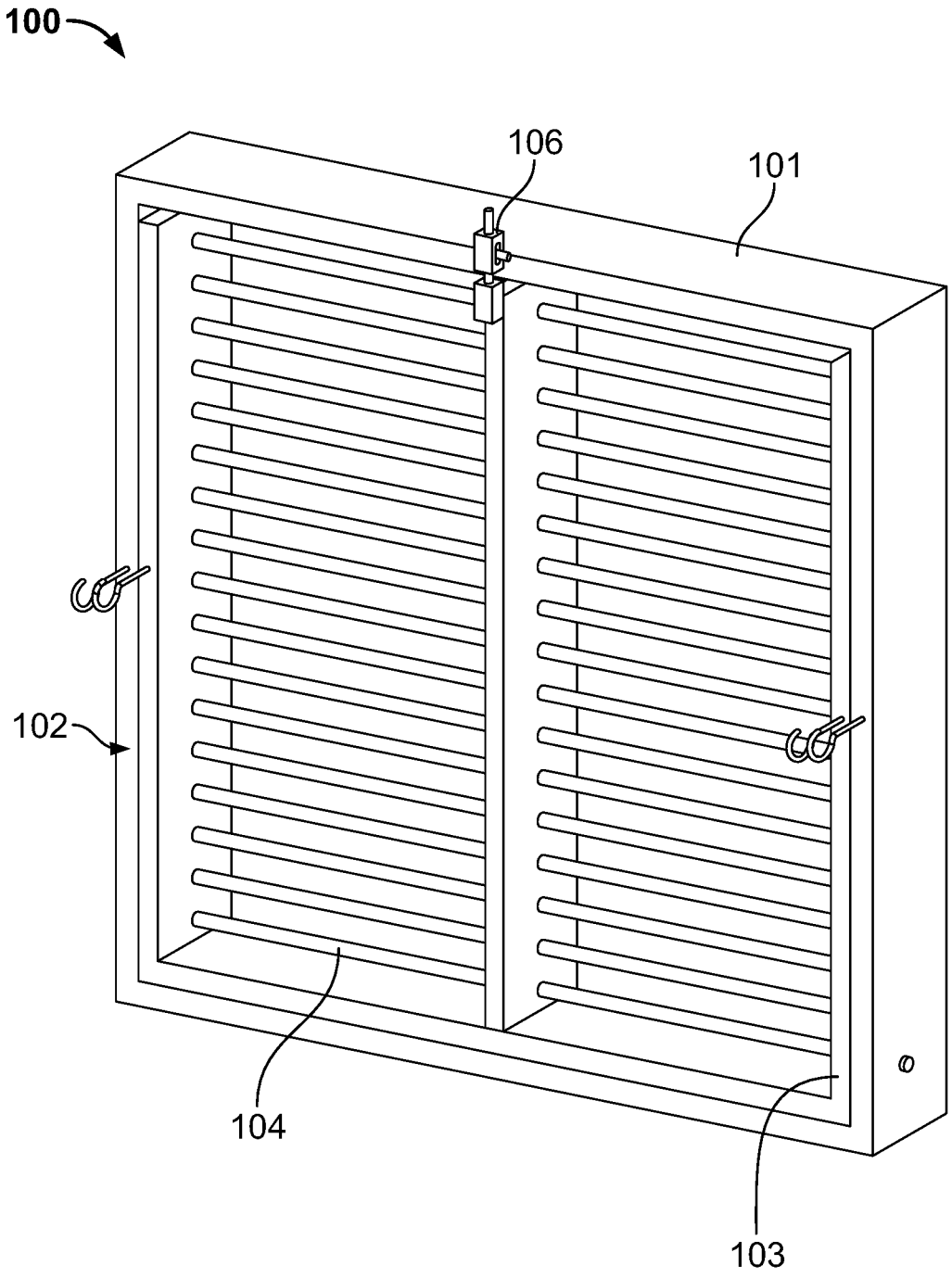

FIG. 1B exemplarily illustrates a front perspective view of a collapsible tie rack 100 in a closed configuration.

Figure 2:
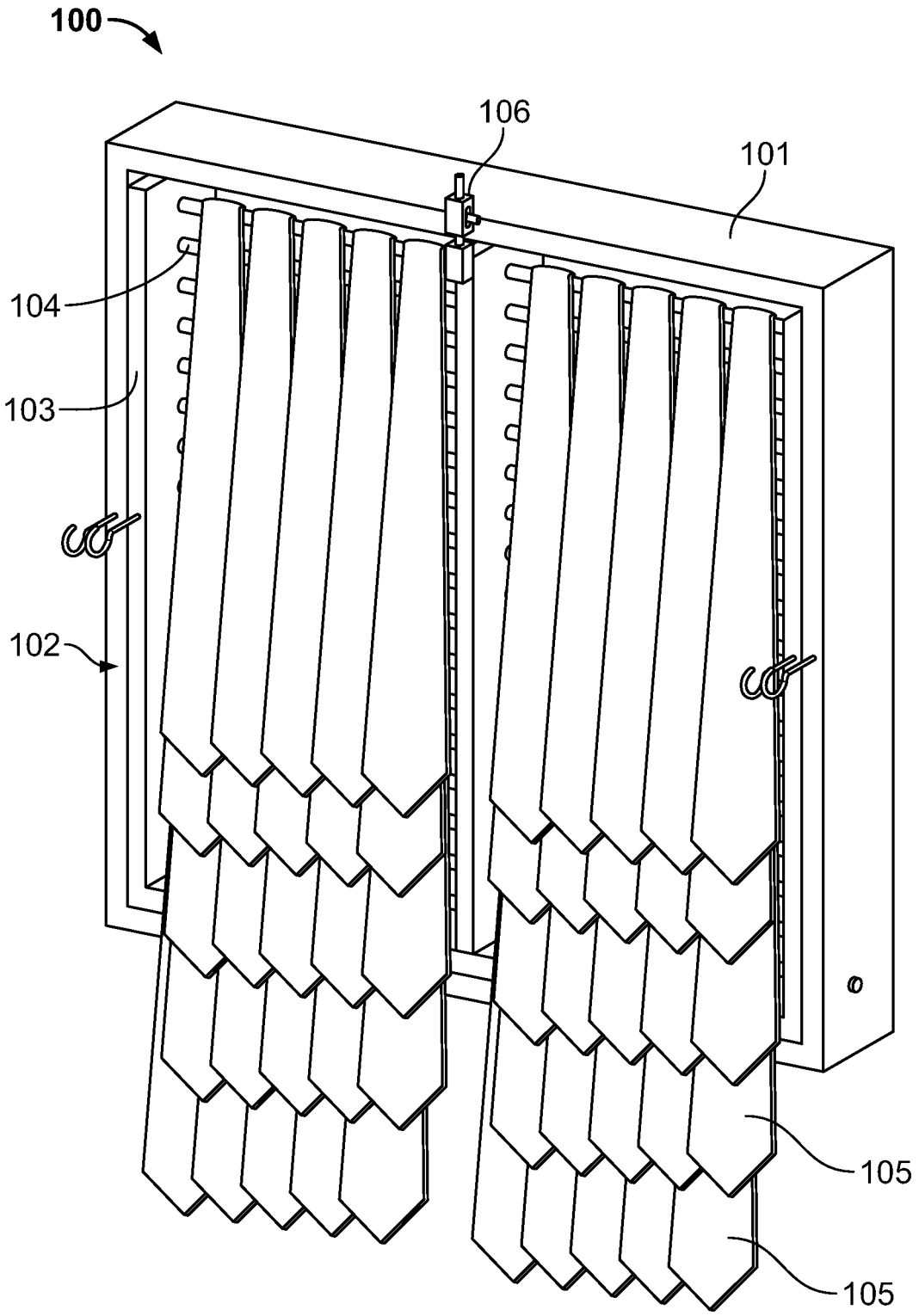

FIG. 2 exemplarily illustrates a front perspective view of a collapsible tie rack showing multiple ties hung in the closed collapsible tie rack.

IV. DETAILED DESCRIPTION OF THE EMBODIMENTS OF THE INVENTION

FIG. 1A exemplarily illustrates a front perspective view of a collapsible tie rack 100 in an open configuration. FIG. 1B exemplarily illustrates a front perspective view of a collapsible tie rack 100 in a closed configuration. A collapsible tie rack comprises a frame member 101 and a hanging assembly 102. The frame member 101 is configured to be mounted on a wall. In an embodiment, the frame member 101 is of a generally rectangular geometrical configuration. Alternately, square shaped, elliptical shaped, circular shaped, etc., frame members 101 may be used based on design or space requirements. The frame member 101 is mounted on the wall using conventional hanging means, for example, using nails, using screw thread members, etc. The frame member 101 encloses a space 101*a* within as exemplarily illustrated in FIG. 1A. The frame member 101 is mounted on a wall or a door, or can use a hanger that hangs over a door. The frame member 101 is made of several materials, for example, metal, wood, plastic, etc. The basic design is a frame member 101 that is stationary with a hanging assembly 102 that fits inside the frame member 101.

The hanging assembly 102 comprises brace members 103 hingedly attached to an inner surface 101*b* of the frame member 101. The brace members 103 are configured to pivot about an end of the frame member 101 to extend from a collapsed configuration, exemplarily illustrated in FIG. 1B, to an open configuration as exemplarily illustrated in FIG. 1A. Further, the hanging assembly 102 is capable of retracting from the open configuration to the collapsed configuration. The hanging assembly 102 further comprises a plurality of hanging rods 104 fixedly attached to the brace members 103. The hanging rods 104 are spaced apart and in a parallel arrangement to hang a plurality of ties 105 as exemplarily illustrated in FIG. 2. In an embodiment, a latch 106 is provided to retain the hanging assembly 102 in an upright position in the closed configuration as exemplarily illustrated in FIG. 1B. Additionally, hooks are provided on the frame member 101 and the brace members 103 of the hanging assembly 102 to restrain the hanging assembly 102 in the open configuration as exemplarily illustrated in FIG. 1A. In an embodiment, the hanging assembly 102 is restrained perpendicular to the frame member 101 to allow a user to easily access and hang multiple ties 105 on the hanging rods 104 of the hanging assembly 102.

FIG. 2 exemplarily illustrates a front perspective view of a collapsible tie rack 100 showing multiple ties 105 hung in the closed collapsible tie rack 100. In the collapsed or closed configuration, the hanging assembly 102 is retracted and positioned within the space 101*a* enclosed by the frame member exemplarily illustrated in FIG. 1A. The hanging assembly 102 is detachably attached to the frame member 101 via one or more attachment elements, for example, a latch 106, as exemplarily illustrated in FIGS. 1B-2. The collapsible tie rack 100 can be produced in several varied sizes as per the need. The brace members 103 have hanging rods 104 positioned across from one side to the other. The hanging assembly 102 is hinged at the bottom end of the frame member 101 and latched at the top using a latch 106. Latch 106 can use magnets or a knob like latch or similar latching means. In the open configuration, the hanging assembly 102 lowered down to permit the ties 105 to be hung on the hanging rods 104, and then raised back up and latched or connected closed using the latch 106. The hanging assembly 102 folds and fits into the exterior frame member 101 and is latched closed allowing the ties 105 to hang close to the wall, wrinkle free, and then to be lowered again when the desired time has come to choose a tie to wear.

In an embodiment, the collapsible tie rack 100 has a height of about 2 feet, length of about 2 feet, and width of about 3.5 feet. The design can be made in diverse sizes for different number of ties. The frame member 101 may be of a square, rectangular, circular, or elliptical shapes based on design and space requirements. Further, the frame member 101 can be created in various shapes, sizes, and colors. The quality of the frame member 101 can depend on the materials used as well as, how it is hinged, latched, hung, mounted, etc. This consists of magnets, cabinet latches, chains, brackets, and over the door hanger. Also, the frame member 101 can have a light, universal serial bus (USB) ports, electrical outlets, mirror, steamer, clock, or a drawer with the clips and tacks and possible hooks on the side to be available while getting dressed. The collapsible tie rack 100 stores many ties 105 while ensuring easy accessibility and visibility. The collapsible tie rack 100 helps keep ties 105 organized. In other embodiments, the frame member 101 may be provided with a mirror to allow a user to view the tie he/she has chosen to wear. The collapsible tie rack 100 keeps ties 105 organized, easy to get to, protects them, and saves space.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A necktie organizer, comprising:

a unitary one piece frame having a top wall, a first frame side wall, a second frame side wall, and a bottom wall each defining an inner space there between, said first frame side wall and said second frame side wall each having a front surface, an inner surface, an exterior surface, and a frame side wall length, wherein the frame is configured to be mounted to a wall;

a hanging assembly that is pivotably attached to the inner surface of the first frame side wall and the inner surface of the second frame side wall by hinges, wherein the hanging assembly pivots between an open position wherein the hanging assembly extends outwardly from the frame with the hanging assembly being generally perpendicular relative to the frame and a closed position wherein the hanging assembly is stored with in the frame with the hanging assembly being generally parallel relative to the frame;

said hanging assembly comprises an open front side, a pair of outer brace members defining side boundaries of the hanging assembly, a longitudinal partition between the pair of outer brace members, and a plurality of hanging rods extending between each outer brace member and the longitudinal partition respectively; wherein the pair of outer brace members each have a brace length and a bottom surface; wherein said longitudinal partition is vertical when said hanging assembly is in the closed position and said longitudinal partition is horizontal when said hanging assembly is in opened position, said longitudinal partition includes a bottom surface and a distal end; wherein each of the hanging rods are configured to receive and store a neck tie thereon in a wrapped manner;

two frame hooks, one of said two frame hooks is mounted directly to the front surface of said first frame side wall and another of said two frame hooks is mounted directly to the front surface of said second frame side wall at a midpoint of each said frame side wall length;

two brace hooks, one of said two brace hooks is mounted directly to the bottom surface of a first outer brace member from said pair of outer brace members and another of said two brace hooks is mounted directly to the bottom surface of a second outer brace member from said pair of outer brace members at a midpoint of each brace length;

a latch assembly having a male latch member comprising a protrusion and a female latch member having a recess therein, wherein said male latch member is mounted to the top wall of said frame and said female latch member is mounted to the bottom surface of said longitudinal partition adjacent to the distal end of the longitudinal partition;

wherein a first hanging rod from said plurality of hanging rods defines a proximal most hanging rod, wherein said proximal most hanging rod is housed within said frame when said hanging assembly is in said open position;

said female latch member having a length, a width and a height, said length and said width being substantially equal, said height is greater than both said width and said length, wherein in the closed position the protrusion of the male member is configured to be inserted within the recess of the female latch member with the female latch member being beneath the male latch member and the protrusion extending through said height of said female latch member to lock the hanging assembly in the closed position; and wherein the two brace hooks are perpendicular relative to the two frame hooks when the hanging assembly is in the open position, wherein an attachment member extends between and connects one of the brace hooks and one of the frame hooks when the hanging assembly is in the open position; wherein the two brace hooks are laterally adjacent and parallel to the two frame hooks when the hanging assembly is in the closed position.

2. The necktie organizer of claim 1, wherein said attachment member is a rope, string or wire.

3. The necktie organizer of claim 1, wherein said hanging rods are parallel and spaced apart with respect to each other.

4. The necktie organizer of claim 1, wherein said hanging assembly is mounted entirely within said inner space in the closed position.

* * * * *